United States Patent [19]

Thrush

[11] Patent Number: 4,781,612

[45] Date of Patent: Nov. 1, 1988

[54] SOCKET FOR SINGLE IN-LINE MEMORY MODULE

[75] Inventor: Roger L. Thrush, Clemmons, N.C.

[73] Assignee: AMP Incorporated, Harrisburg, Pa.

[21] Appl. No.: 35,273

[22] Filed: Apr. 2, 1987

Related U.S. Application Data

[63] Continuation of Ser. No. 800,181, Nov. 20, 1985, abandoned, which is a continuation-in-part of Ser. No. 670,857, Nov. 13, 1984, Pat. No. 4,557,548, which is a continuation-in-part of Ser. No. 561,392, Dec. 14, 1983, Pat. No. 4,558,912.

[51] Int. Cl.[4] ..... H01R 9/09

[52] U.S. Cl. ..... 439/328; 439/62; 439/630

[58] Field of Search ..... 339/176 MP, 75 MP, 91 R; 439/325, 326, 327, 328, 329, 59–62, 629–637

[56] References Cited

U.S. PATENT DOCUMENTS

| | | | |
|---|---|---|---|
| 3,270,313 | 8/1966 | Sautois | 339/176 MP |
| 3,567,998 | 3/1971 | Ammerman | 339/176 MP |
| 3,932,016 | 1/1976 | Ammenheuser | 339/75 MP |
| 4,017,138 | 4/1977 | Evans | 339/75 MP |
| 4,579,411 | 4/1986 | Cobaugh et al. | 339/75 MP |

FOREIGN PATENT DOCUMENTS

| | | | |
|---|---|---|---|
| 2732519 | 2/1979 | Fed. Rep. of Germany | 339/176 MP |

OTHER PUBLICATIONS

AMP Incorporated Catalog No. 75-316 (2/82), p. 5.

*Primary Examiner*—J. Patrick McQuade
*Attorney, Agent, or Firm*—Robert W. Pitts; Eric J. Groen

[57] ABSTRACT

Socket for receiving edge of a substrate of a single in-line memory module comprises a dielectric housing having an elongate channel. Contact terminals are received within cavities located in the channels. One embodiment of contact comprises a pair of opposed arms formed upward to a bend where each is formed through an obtuse angle toward the other arm of the pair, one arm being stamped from a continuous carrier strip leaving an aperture, each contact being attached to the carrier by a pair of straps. One embodiment of the socket housing includes support brackets on either end of the elongate channel. Guide slots in the support bracket align and support the module. An integral resilient flange engages holes in the module substrate to hold the module in position.

9 Claims, 8 Drawing Sheets

8
2
12
19
50
34
40
32
48
18
20
54
47
33
35
46
44
45
26
27
23
22
28
52
24
4
6
50'
30
19'
34'
48'
18'
47'
38
33'
46'
45'

SOCKET FOR SINGLE IN-LINE MEMORY MODULE

This application is a continuation of application Ser. No. 800,181 filed Nov. 20, 1985, now abandoned, which is in turn a Continuation-in-Part of U.S. patent application Ser. No. 670,857 filed Nov. 13, 1984, now U.S. Pat. No. 4,557,548, which is in turn a Continuation-in-Part of U.S. patent application Ser. No. 561,392 filed Dec. 14, 1983, now U.S. Pat. No. 4,558,912.

BACKGROUND OF THE INVENTION

The present invention relates to a socket which receives the edge of a chip carrier substrate, and more particularly to a socket for a single in-line memory module.

Edge connectors for printed circuit boards are well known. These are generally mounted to a mother board and employ card guides which direct a daughter board into contact with terminals in a dielectric housing. The terminals may lie in two rows and make independent contact with traces on opposite sides of a daughter card, as in U.S. Pat. No. 4,077,694, or may lie in a single row, each terminal having two arms for redundant contact on opposite sides of a board, as in U.S. Pat. No. 3,601,775. In any it is desirable to design the terminals and housings to preclude the possibility of bending the contact portion of a terminal beyond the elastic limit, which could affect the integrity of contact in future inserted boards.

The advance of semiconductor technology has resulted in development of chip carriers which comprise substrates on which the chips are mounted and electrically connected by fine wire leads. The substrates are plugged into sockets having resilient contact members which make conact with surface traces on the substrate. See, e.g., U.S. Pat. No. 3,753,211, which discloses a socket having terminals for contact with opposed edges. In some applications, as where board space is at a premium, it is desirable to connect the substrate on edge to the board. One such application is the use of edge mounted memory modules in the form of single in-line memory modules. Standard card edge connectors cannot be simply downsized to meet the requirements of a substrate to circuit board connection, known as the level two connection. This connection is relatively much smaller and requires simple, compact contacts on a much closer spacing. As such, variations in board thickness and board warpage are much more likely to deflect contact means beyond the elastic limit, which would adversely affect contact pressure and thus the integrity of the electrical connection of future substrate insertions.

SUMMARY OF THE INVENTION

The present invention is directed to a socket for mounting on a printed circuit board and intended to receive the edge of a chip-carrying ceramic and plastic laminated substrate in the form of a single in-line memory module. The connector comprises a dielectric or insulative housing molded to receive a row of stamped and formed U-shaped metal contacts in a channel in the base of the socket. A U-shaped contact is formed with substrate contact surfaces on convex rolled inside surfaces of directly opposed upstanding arms and a flat pin formed downward from the base of the contact section. This is mounted through an aperture in the base of the housing, which aperture is chamfered toward the cavity to permit lateral flexure of the pin normal to the rolled surface thereof. The substrate is aligned with the channel in the base of the dielectric housing by guide slots formed in support brackets or guides on each end of a central body portion. The brackets or guides extend upright from the central body portion to permit the single in-line memory module to be positioned in an upright position, thus saving space on the printed circuit board. Each bracket has a guide slot extending from the top which is aligned with and merges with the channel. A resilient latch extends upwardly from the central body portion adjacent each end of the channel. The latch is deflected during insertion of the module, as the guide slots precisely position the module relative to the channel and to the terminals. When the module is fully inserted, the resilient latch engages an edge on the module substrate to stabilize the module.

BRIEF DESCRIPTION OF THE DRAWINGS

FIG. 3 is a cross section of the socket with the substrate in place.

DETAILED DESCRIPTION OF THE PREFERRED EMBODIMENT

Figure 1:
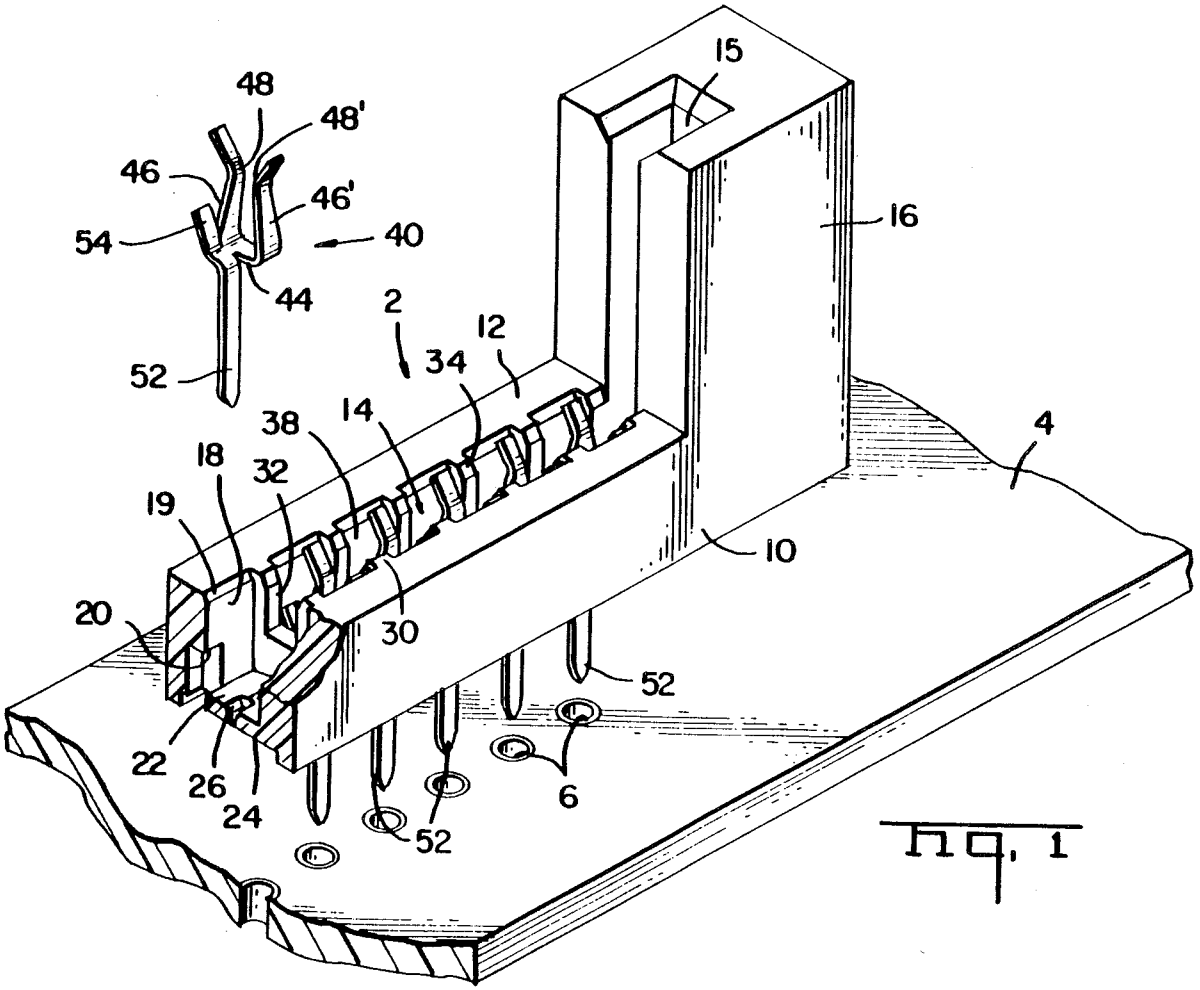
FIG. 1 is a partially exploded socket with the housing cut away.

FIG. 1 is a sectioned perspective of a socket 2 having a single in-line row of pins poised above a circuit board 4 having a row of plated through holes 6. Each socket 2 comprises a dielectric housing 10 having a substrate receiving face 12 having an elongate substrate receiving channel 14 therein. The channel 14 is bounded at the ends by endwalls 15 in upstanding guides or upright support brackets 16 which are molded integrally with the housing. The channel 14 is substantially symmetric to a central plane extending the length of the housing 10 and is further bounded by opposed parallel sidewalls 18, 18', which meet face 12 at respective chambers 19, 19', and a floor 22. Each sidewall 18 is profiled with a shoulder 20 which faces the floor 22. The channel 14 is interrupted by equally spaced partitions 30 having respective mutually aligned U-slots 32 which open on face 12 and are likewise symmetric to the central plane of the housing 10. The channel 14 comprises a plurality of contact receiving cavities 38 separated by the partitions 30; an elongate aperture 26 extends through the portion of floor 22 in each cavity 38 to the recessed face 24 in housing 10 which is opposite substrate receiving face 12.

Referring still to FIG. 1, a generally U-shaped contact 40 is shown exploded from its cavity 38. Each contact 40 comprises a base 44 from which arms 46, 46' are formed upwardly, the arms 46, 46' being formed with respective mutually facing convex contact surfaces 48, 48'. A flat pin 52 is offset to the side of base 44 and is formed downward to be received in aperture 26. The contact 40 is also formed with a lance 54 to be received against shoulder 20.

Note, that like any stamped and formed metal contact, the contact 40 has both sheared and rolled surfaces. The rolled sqrfaces are present on the strip stock prior to stamping, and the sheared surfaces subsequently appear as a result of stamping. All axes about which the terminal 40 is then formed are substantially parallel, and parallel the central plane of the connector. Since the thickness tolerances between rolled surfaces may be more closely controlled than between sheared surfaces, it is possible to closely control the spring characteristics of the terminal. Note that the contact surfaces 48, 48' are rolled surfaces. All deflecting forces which the terminal is designed to encounter are normal to one or more rolled surfaces, there being little or no deflecting force on any sheared surface. This is preferable as sheared surfaces are more susceptible to cracking under stress.

Figure 2:
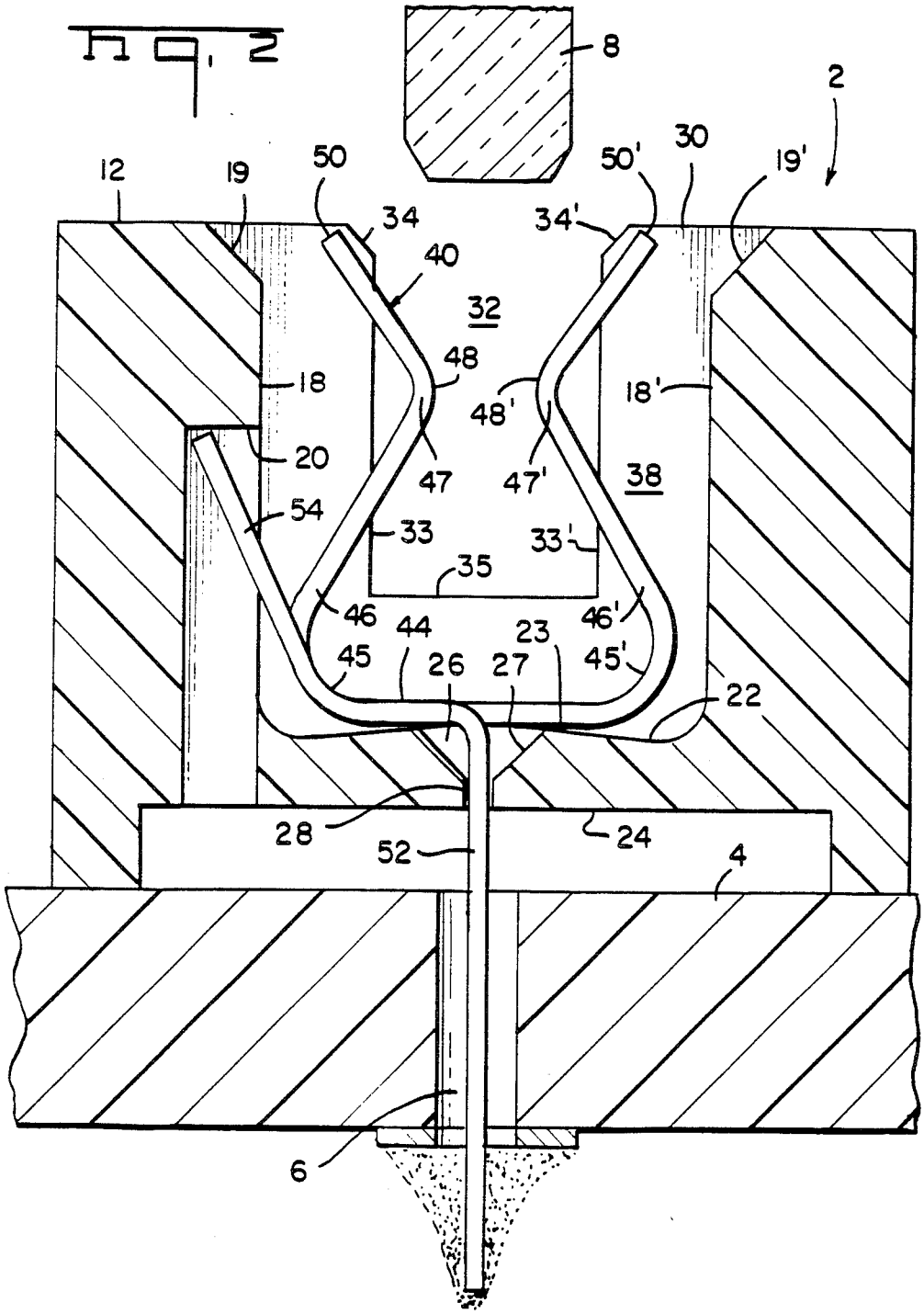
FIG. 2 is a cross section of the socket in place on a circuit board.

FIG. 2 is a cross section of the socket 2 in place on a circuit board 4, with the contact stems in through holes 6 and soldered to traces on the bottom of the board 4. Each aperture 26 has a chamfered lead-in 27 in floor 22 and a retaining section 28 which receives the pin 52 closely between the lead-in 27 and bottom face 24. The base 44 is substantially flat and rests on the convex portion 23 of floor 22, the apex of the convex portion 23 lying along the central plane of housing 10. In this embodiment, the convex portion 23 extends the length of floor 22, the lead-ins 27 of elongate apertures 26 lying along the apex of the convex portion 23. The arms 46, 46' are continuous with base 44 via bends 45, 45' respectively, where the metal is formed through obtuse angles so that arms 46, 46' extend toward each other to surfaces 48, 48'. There the arms 46, 46' are bent away from each other to distal ends 50, 50' via bends 47, 47' respectively, the substrate contact surfaces 48, 48' thus being formed on the outside of respective bends 47, 47'. Note that the distal ends 50, 50' are not exposed beyond partition 30, whereby the possibility of stubbing an inserted substrate 8 against one of ends 50, 50' is precluded. The chamfers 34, 34' serve to guide the substrate 8 into U-slot 32, which is bounded by sidewalls 33, 33' of floor 35. The contact 40 is retained in cavity 38 by the cooperation of lance 54 and shoulder 20. Alternative retention means such an interference fit between pin 52 and retaining section 28 are contemplated.

FIG. 3 depicts a substrate 8, comprising one component of a single inline memory module, inserted between arms 46, 46' so that the contact surfaces 48, 48' bear against the substrate 8, which is shown offset from the center plane of the housing 10 to illustrate a feature of the invention. Since ceramic and plastic laminated substrates of single in-line memory modules suffer warpage, some lateral deflection of the arms 46, 46' of some contact 40 will occur in addition to the spreading required to accommodate the substrate By design, most of this deflection occurs in the pin 52 where it passes into lead-in 27, and the base 44 rocks on convex surface 23. This lateral deflection of arms 46, 46' and rocking of base 44 is limited by sidewalls 33, 33' of U-slot 32, which limits the lateral position of the substrate 8. Chamfers 19, 19' receive the distal ends 50, 50' at maximum lateral deflection. The contact 40 and housing 10 are designed so that no part of the contact 40 can be deflected beyond the elastic limit, thereby insuring the required contact force on the surface of substrate 8 after repeated insertions. The floor 35 of U-slot 32 prevents the substrate 8 from butting the base 44.

Figure 4:
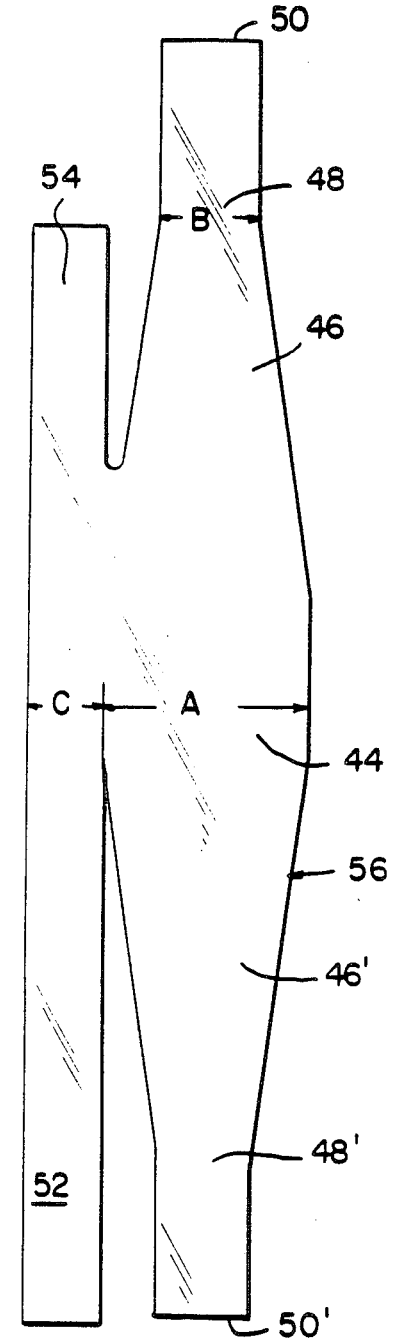
FIG. 4 is a plan view of a contact blank prior to forming.

FIG. 4 illustrates the stamping 56 used for manufacture of a terminal 40, prior to the forming operations. The dimension "A", about 0.055 in., corresponds to the center of base 44; dimension "B", about 0.025 in., corresponds to the contact surface 48, while dimension "C", about 0.020 in., corresponds to the width of pin 52. Thus it can readily be seen that the stem 52 will flex to accommodate board warpage more readily than the arms 46, 46'.

Figure 5:
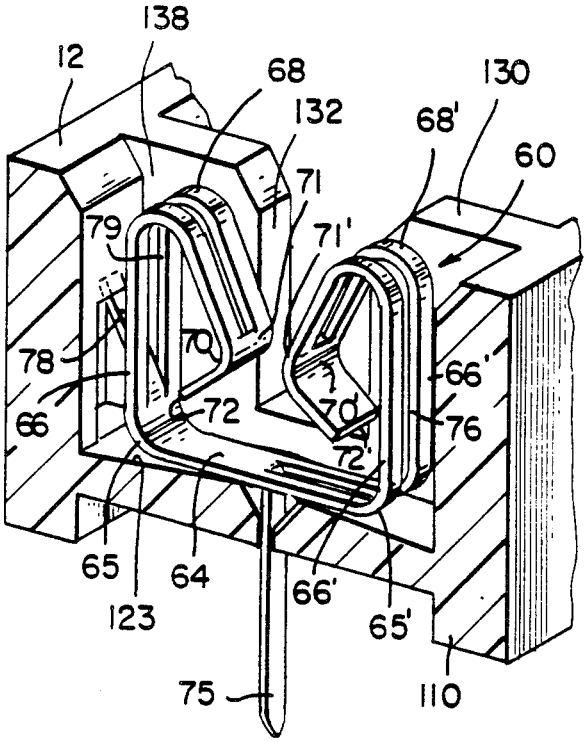
FIG. 5 is a perspective of an alternative embodiment of the contact.
Figure 7:
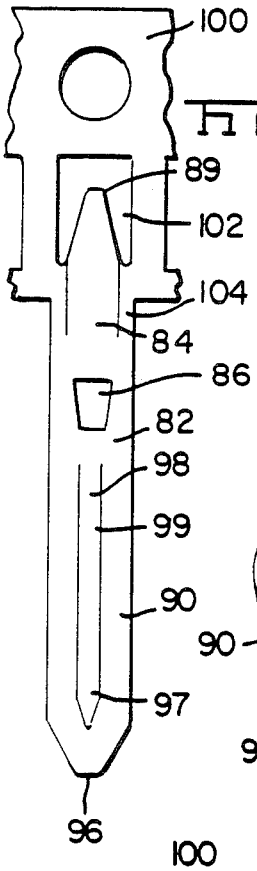

FIG. 5 illustrates an alternative contact 60 according to the present invention. The contact comprises a substantially flat base 64 and contact arms 66, 66' which are formed upward from the base 64 through ninety-degree bends 65, 65' respectively. The arms 66, 66' are formed through obtuse angles to extend toward the opposite arm of the pair, thence through bends 70, 70' to extend away from each other to distal ends 72, 72' respectively. The retaining lance 78 is struck from arm 66, leaving slot 79, while the pin 75 is struck from base 64 and arm 66, leaving slot 76. The housing 110 is similar to that described for terminal 40 and likewise has cavities 138 with convex portions 123 in the floor on which the contacts rock to accommodate substrate warpage. As before, the U-slots 132 in partitions 130 result in limited deflection of the contact 60.

The present invention is directed to a very compact socket, where more complex metal forming operations, long contact arms, and large housings are not desirable. The overall height of the housing 10 described above is 0.160 in. from the board 4 to face 12; the height of the contact 40 from base 44 to distal ends 50, 50' is about 0.120 in. The centerline spacing between contacts 40, 60 in adjacent cavities is 0.075 in. or 0.100 in. and the substrate 8 to be received is 0.040 in. thick. The contacts 40, 60 are designed to work through a ±0.0075 in. range of substrate warpage, the width of U-slot 32 being 0.058 in.

Figure 6:
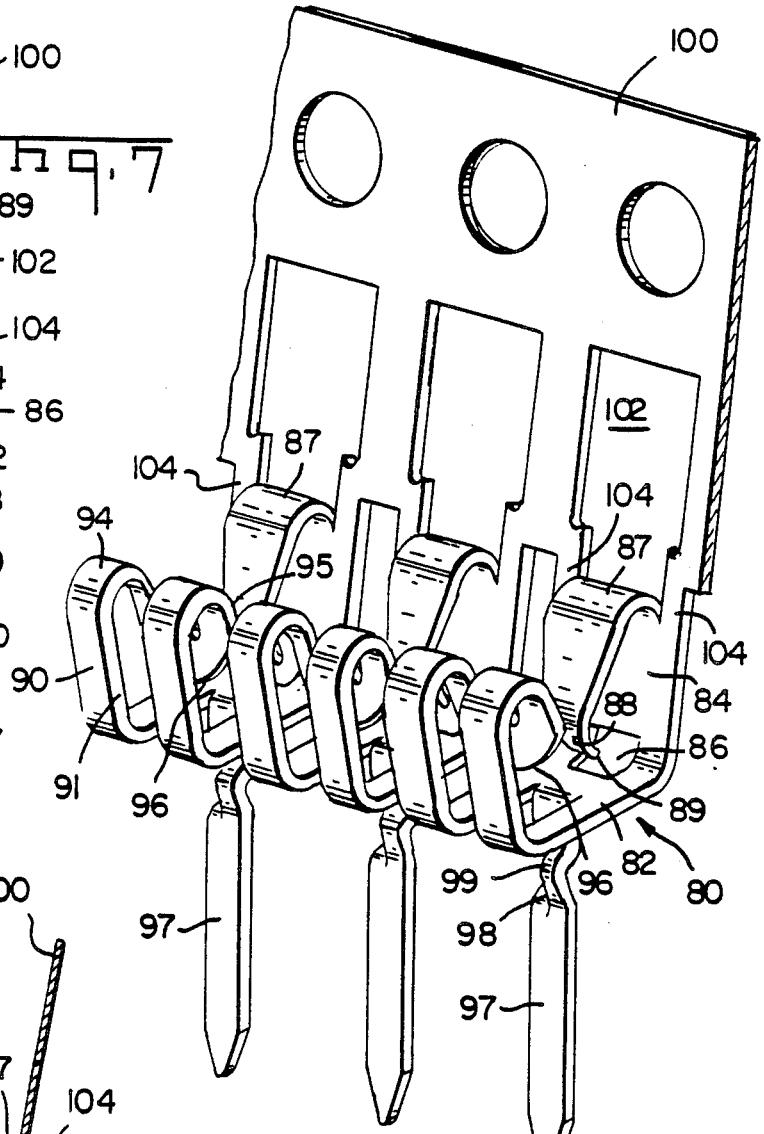
FIG. 6 is a perspective of another embodiment in strip form.

FIG. 6 illustrates another alternative contact 80 in strip form. Each contact 80 comprises a contact section with a first contact arm 84 and a second contact arm 90 formed upward from a base 82. Each arm 84, 90 is formed upward to a respective bend 87, 94 where it is formed through an obtuse angle to extend toward the other arm of the pair. Each arm 84, 90 has a respective contact surface 88, 95 which faces the contact surface on the other arm of the pair. The contact surface 88, 95 lie on bends where each arm 84, 90 is formed away from the opposite arm of the pair to a respective distal end 89, 96.

The contacts 80 are attached to a continuous carrier strip 100 laterally thereof in side-by-side relation. The first arm 84 is stamped in part from the carrier strip 100 and the bend 87 is formed therefrom leaving an aperture 102. Each contact 80 is attached to the carrier 100 by a pair of straps 104 extending from opposite sides of the aperture 102 to opposite edges of the first arm 84 proximate to the bend 87. A pin 97 is stamped out of second arm 90 leaving a slot 91 therein. The pin 97 is formed downward from the base 82 for reception in a housing as previously describd. Each pin is split along a close-ended shear line 98 proximate to the base 82, and a pair of retaining portions 99 are formed in opposite directions parallel to the plane of the shear line. Note that the portion of first arm 84 which is formed out of aperture 102 is profiled more narrowly than the opposed portion of second arm 90, and further that an aperture 86 is stamped in first arm 84 where the first arm 84 is formed upward from the base 82. These features are provided to offset the effect of slot 91 in the second arm 90, and are profiled to assure that the spring characteristics of both arms 84, 90 are substantially identical.

Figure 7:
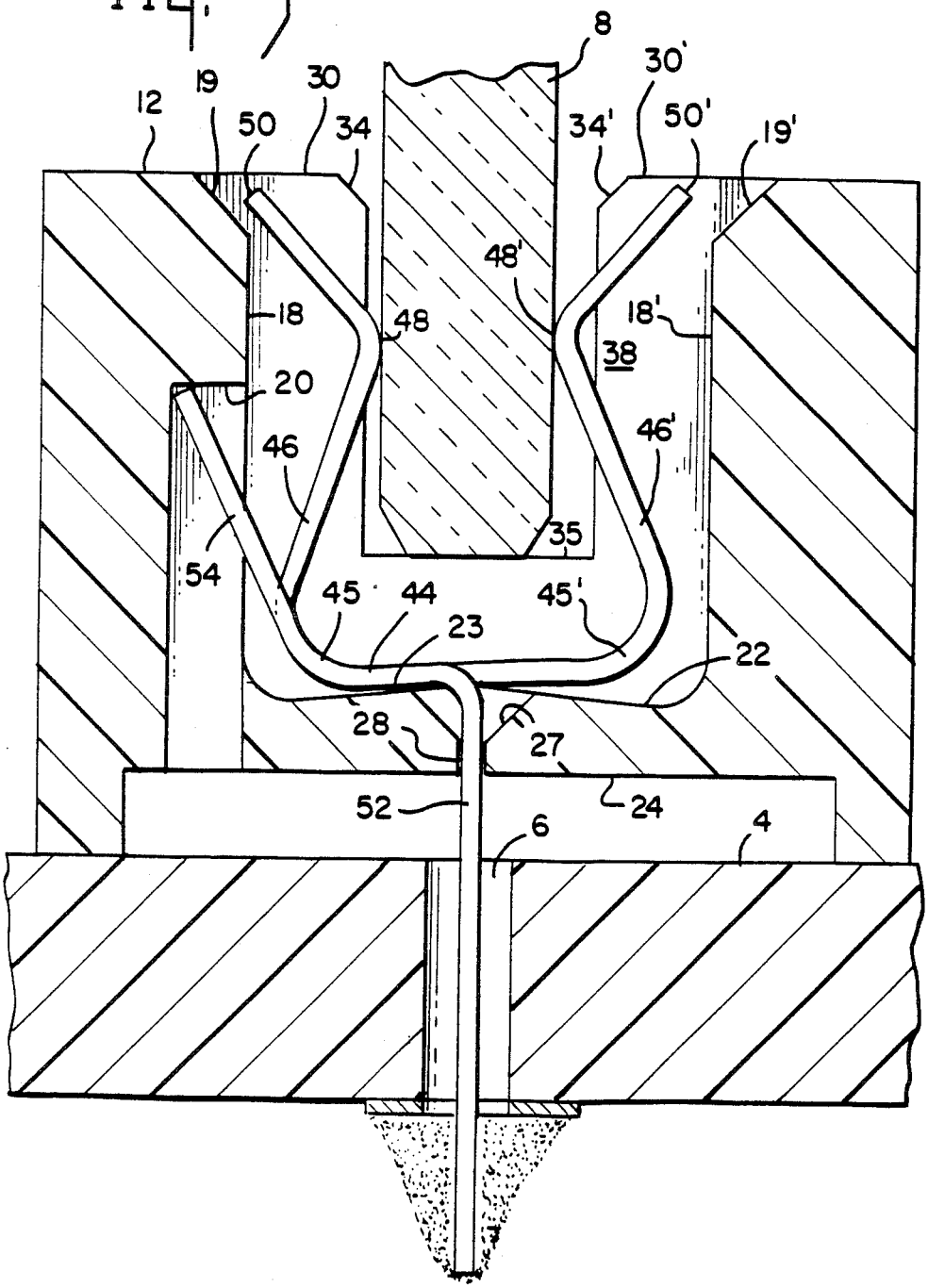
FIG. 7 is a plan view of the stamping for the terminal of FIG. 6.

The stamping from which a contact 80 is formed and the portion of carrier strip 100 to which it attaches are shown in FIG. 7; here the features described in conjunction with FIG. 6 are apparent as they appear prior to forming.

The continuous strip shown in FIG. 6 offers several advantages in handling and manufacturing. Since each contact 80 is attached to the carrier at two points (straps 104), the contacts resist twisting from the array shown. Since the straps 104 are located remotely from the base 82, this permits the contacts 80 to be partially inserted in a housing 110 (FIG. 8) before removing the carrier strip 100, the pins 97 being spaced as the apertures in which they are received. The housing 110 has features substantially as described for housing 10 (FIG. 1).

Figure 8:
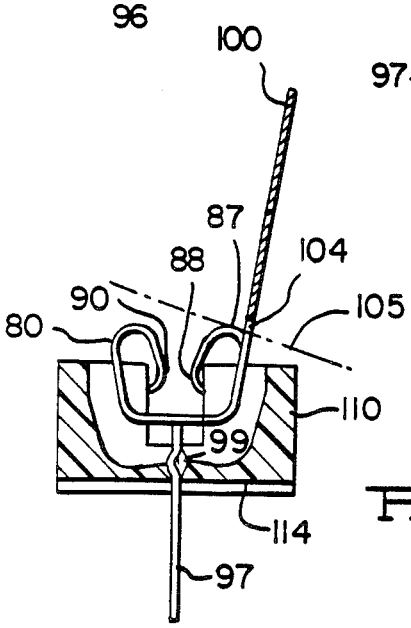
FIG. 8 is an instantaneous side section of the strip being assembled to a housing.
Figure 12:
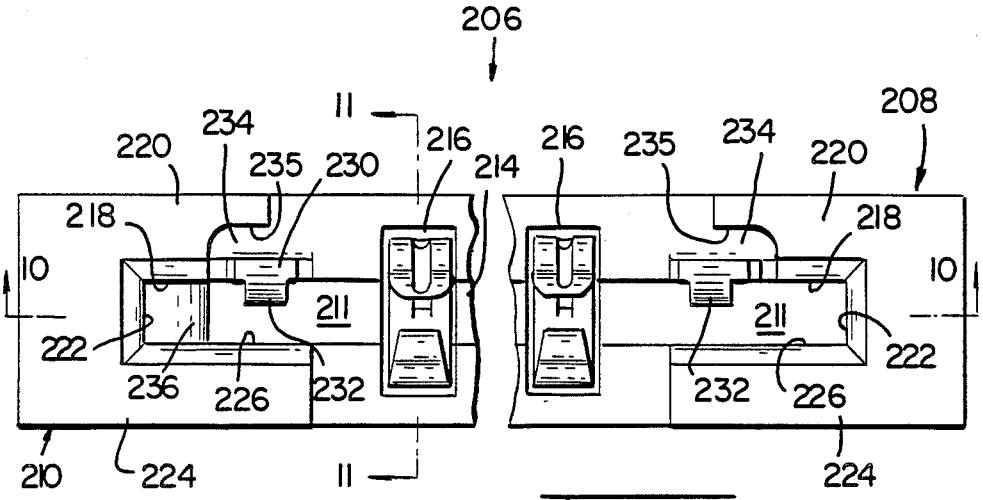
FIG. 12 is a top view taken along section lines 12—12 in FIG. 9.

Referring to FIG. 8, once a strip of contacts 80 are partially assembled to housing 110 as shown, the carrier strip 100 is removed by severing at line 105. This may be accomplished by shearing or alternatively the straps 104 may be scored during stamping and broken at this stage. A fixture profiled similarly to a substrate is subsequently inserted in the row of contacts 80 and they are pushed home so that the retaining portions 99 (or by the alternative interference fit retention means) are below the bottom surface 114 of housing 110 to retain the contacts 80 therein.

Figure 9:
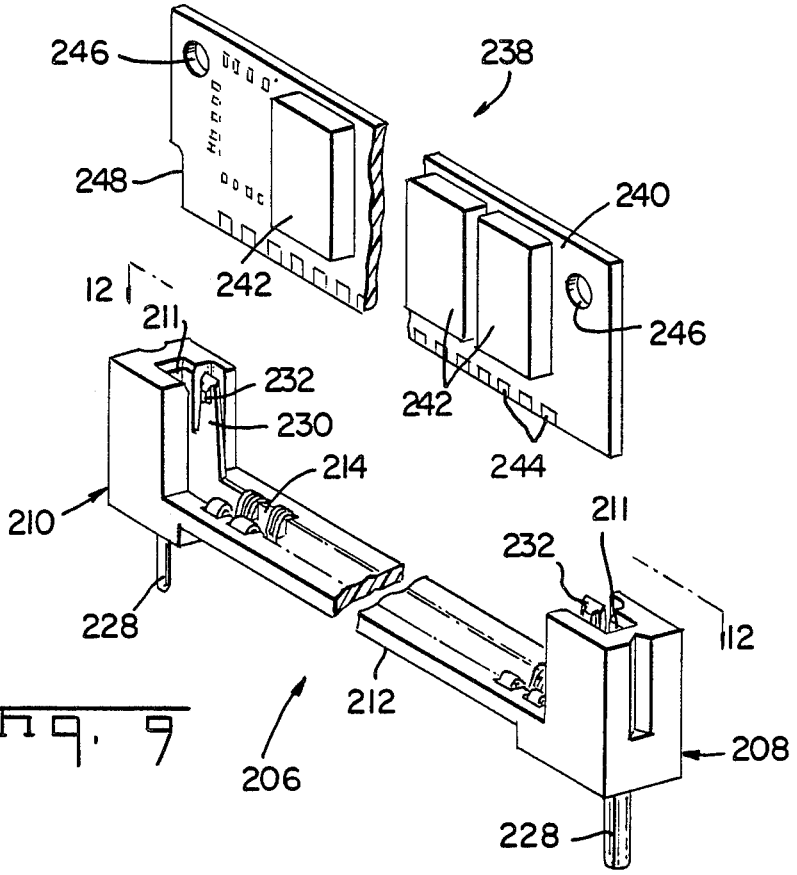
FIG. 9 is a perspective view of an embodiment in which the housing includes a latch engagable with a module substrate.
Figure 10:
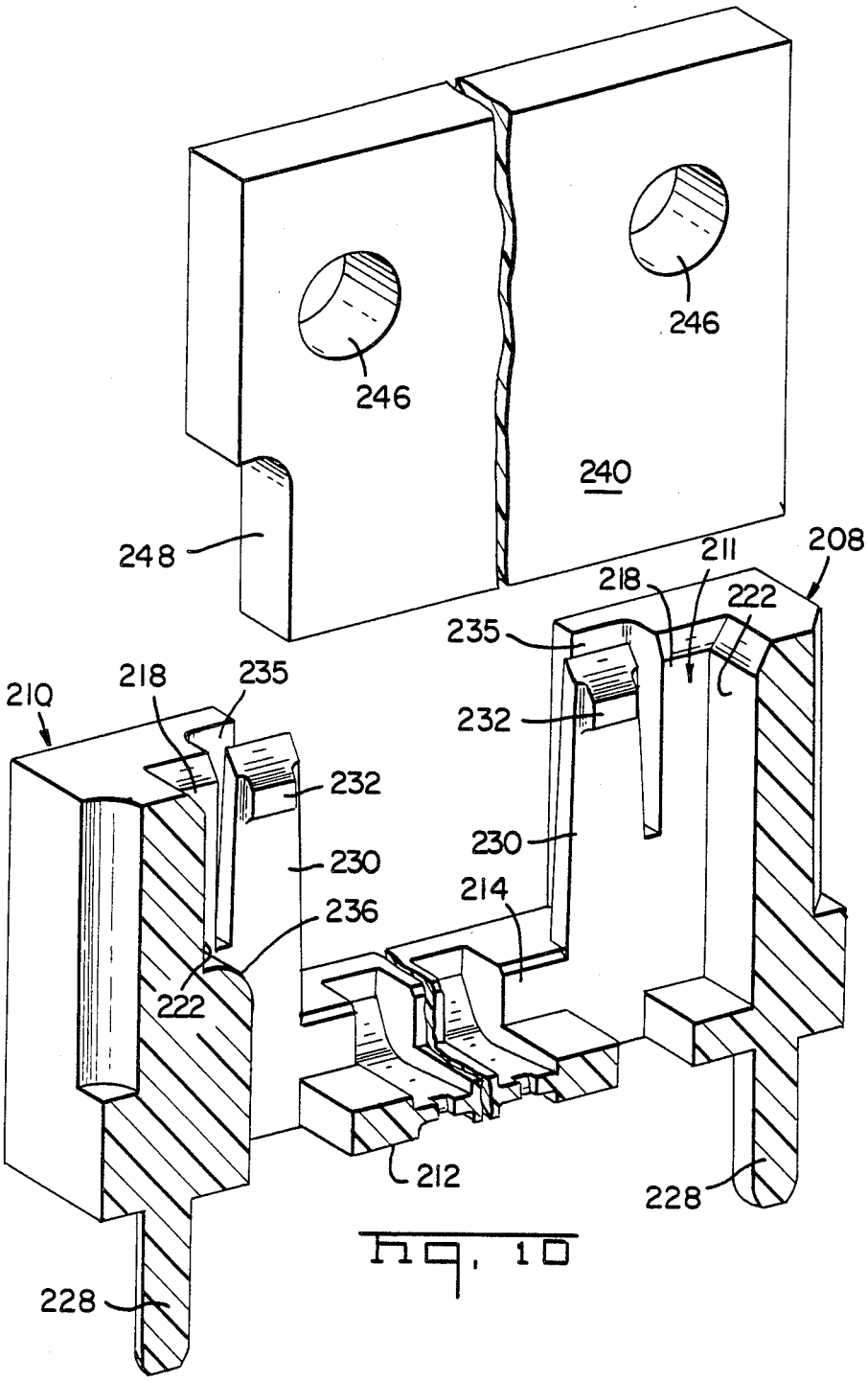
FIG. 10 is a perspective view showing portions of the socket broken away for clarity.
Figure 11:
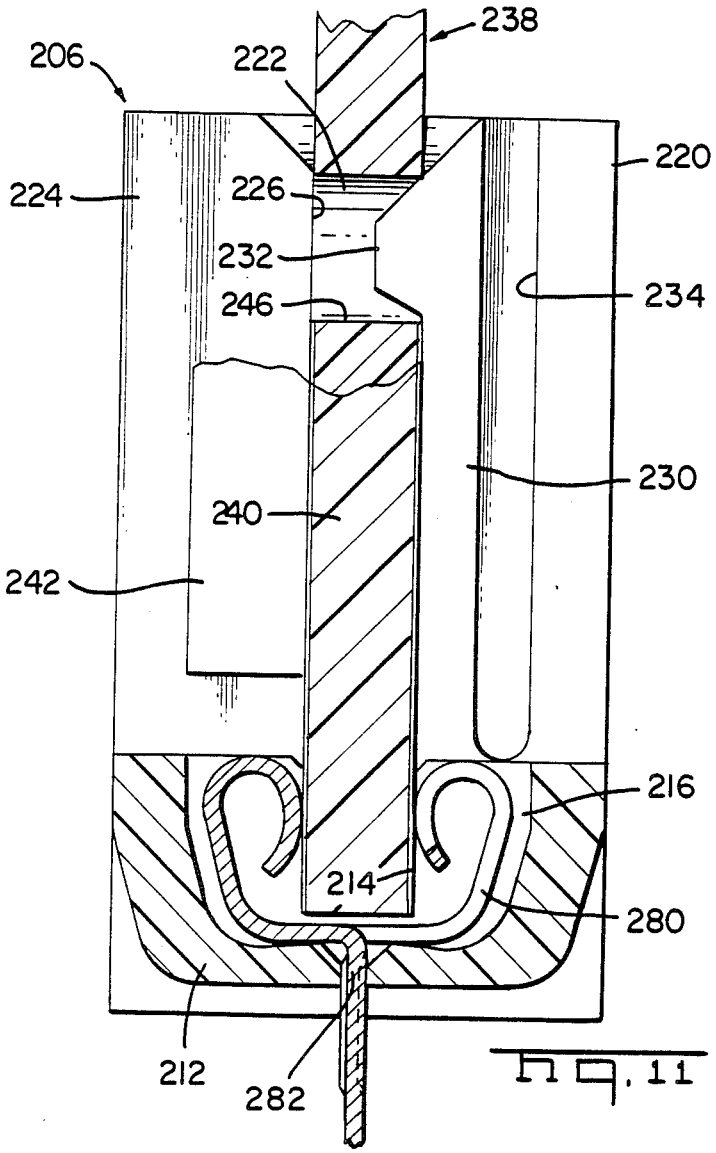
FIG. 11 is a sectional view showing engagement of the module substrate by the resilient latch.

The embodiment of FIG. 9–11 is especially adapted for use with the terminal configuration shown in FIGS. 6–8. The dielectric housing shown in the embodiment of FIGS. 9–11 includes means for precisely aligning the substrate on a in-line memdry module with the channel at the base of this housing so that edge contacts on the single in-line memory module are precisely aligned with the terminals within the channel.

FIG. 9 shows a single in-line memory module consisting of a plurality of microelectronic packages 242 mounted on a ceramic or plastic laminated substrate 240. The preferred manner of mounting these microelectronic packages onto the substrate 240 is to surface mount the leads on the microelectronic packages 242 to module contacts on the ceramic or plastic laminated substrate 240. Traces on a ceramic or plastic laminated substrate lead from the module contacts to edge contacts 244 located along the lower end of the module substrate 240. Note that in the preferred embodiment of this invention these microelectronic packages are located side by side. The module 238 has comparatively low profile even though it is intended to be mounted upright on the surface of the printed circuit board as shown in FIG. 9. The socket used with a single in-line memory module 238 must have a relatively low profile and be capable of high density interconnections to retain the advantageous features of this module packaging concept.

As with the other embodiments of this invention, the substrate 240 is inserted into the socket housing 206 with the substrate lower edge and its associated edge contacts 244 being positioned in an elongate channel 214 opening on an upper substrate receiving surface of an elongate central body portion 212. The central body portion 212 is flanked by upright support brackets 208 and 210, each extending upwardly beyond the central body portion 212. A plurality of cavities 216 located in the central body portion 212 communicate with channel 214, and are each adapted to receive a terminal 280 similar to contact terminal 80 shown in FIGS. 6–8. The contact terminals are positioned within the central body portion 212 in essentially the same manner as for the previous embodiments of this invention, although contacts 280 are retained in the central body portion by an interference fit 282.

Each of the support brackets comprises an integral part of the dielectric housing 206. The support brackets 208 and 210 each have a inwardly facing guide slot 211 extending from the base of the housing upwardly to the upper end of the support bracket. These guide slots 211 are generally U-shaped and are defined by two opposed sides 218 and 226, respectively comprising the inner surface of laterally extending walls 220 and 224. An outer enclosed end 222 facing inwardly toward the middle of the socket completes the guide slot. These guide slots extend from the upper end of the support brackets 208 and 210 and each serves to position the module substrate 240 in alignment with the channel 214. To this end, the guide slots 211 are aligned and merge with the channel 214. Thus, the guide slots 211 serve to precisely align the module substrate 240 with channel 214. The upstanding guide slots 211 also support the side edges of the module substrate 240 to retain the substrate in position during the life of the single in-line memory module.

One side or opposed surface of the guide slot 211 extends further inwardly than the opposite side. A latch 230 is located along this shorter side of the guide slot 211 and is positioned within a recess 234 defined within the lateral sidewall of this support bracket. The resilient latch 230 is formed integrally with the dielectric housing and extends upwardly from the bottom of the housing toward the top. This preferred embodiment of the resilient latch 230 is relatively long, thus imparting a fair amount of resilience due to the length alone. This configuration is especially suitable for use in a housing formed of a relatively rigid material such as polyphenylene sulfide, commonly referred to as Ryton, a trademark of Phillips Petroleum. Material such as Ryton is often employed in housings which must be subjected to extreme temperatures. Since the housing of this socket can encounter the relatively high temperatures encountered in vapor phase reflow soldering or other reflow soldering operations, when surface mount rather than through hole terminals are used to attach the socket to the printed circuit board, a rigid material such as Ryton has been employed. Although the latch configuration 230 is especially resilient for a rigid material such as Ryton, anti-overstress surfaces are provided in the support brackets to prevent excess deflection of the resilient latch. These anti-overstress surfaces include the inner surface 226 of the side opposite the latch 230 and the lateral surface 235 of recess 234 located behind the latch 230. For normal insertion of the single in-line memory module, the surface 235 would provide for overstress. However, the module might inadvertently be inserted between surface 235 and the latch 230. Thus, the latch would engage slot surface 226, again preventing overstressing of the latch. Since the lateral walls of the support brackets are relatively more rigid than the latch, due to their cross-sectional configuration, the latch remains resilient while the integral housing provides an overstress feature.

When the module substrate 240 is fully inserted into the socket 206 with the edge contacts engaging terminals located in cavities 216, the boss 232 at the upper end of latch 230 engages an edge on the substrate 240 to hold the module in a fully inserted position. In the preferred embodiment of this invention, each substrate has a pair of holes 246 located at either end. When the module is fully inserted into the socket 206, the boss 232 engages the holes 246 to engage an edge of the hole. These holes 246 are located adjacent the upper edge of the module and the latch 230 is deflectable during insertion of the module but snaps into the hole upon full insertion. In order to ensure that the module is properly inserted, the substrate 240 is provided with a relief 248 along one lower edge. A mating polarizing key 236 can then be positioned such that it will extend from the outer enclosed end of the guide slots 211. The module 238 can then only be inserted with the relief of 248 mating with the polarizing key 236.

As shown in FIGS. 9–12, the latching boss 232 is located on a resilient arm 230 which forms an integral part of the housing. This integral arm 230 is joined to the housing only along the base of the arm 230. (See FIGS. 10, 11, and 12.) Resilient arm 230 is deflectable from the undeflected position shown in FIG. 12 to permit insertion of substrate 240. As shown in FIG. 11, the resilient arm 230 returns to the undeflected position when the substrate 240 has been fully inserted and the latching boss 232 extends partially through hole 226. Since the latching boss extends partially through hole 226, it can be seen that the latching boss also extends partially over the channel 214.

The foregoing description is exemplary and not intended to limit the scope of the claims which follow.

I claim:

1. A low profile, high density socket for positioning a single in-line memory module upright on a printed circuit board, the module comprising a plurality of microelectronic packages mounted on a low profile substrate, the substrate having edge traces leading from module contacts to edge contacts along a lower substrate edge, the socket comprising: a plurality of terminals each comprising means for interconnection between the substrate edge contacts and the printed circuit board; and an elongate dielectric housing further comprising a central body and upright support brackets extending above the central body at either end thereof, the central body having an elongate channel opening along an upper module receiving face, the terminals being positioned side by side along the channel, each support bracket having an inwardly facing guide slot extending from the top of the bracket, aligned with and merging with the channel, the guide slots comprising means for aligning and supporting a module upon insertion of the module substrate lower edge into the channel with the edge contacts in engagement with the terminals, and a resilient latch integral with the dielectric housing and extending from the central body toward the top of each support bracket adjacent each guide slot, and comprising means for engaging the module adjacent an upper edge of the module, each guide slot being defined by an outer enclosed end, and first and second opposed sides extending inwardly therefrom, the latch being on the second side facing the first side, the first and second sides comprising respectively the sides of first and second laterally extending walls of the brackets, the first laterally extending wall extending further inward than the second laterally extending wall, the second laterally extending wall having a recess therein, the latch being positioned within the recess.

2. The socket of claim 1 wherein each latch is deflectable upon engagement of a side of the substrate during insertion of the module into the socket.

3. The socket of claim 2 wherein each latch comprises means for engaging an edge on the substrate upon full insertion of the module into the socket.

4. The socket of claim 3 wherein each latch comprises means for engaging the edge of a hole in the substrate adjacent the upper edge thereof.

5. The socket of claim 3 wherein each latch is located between opposed surfaces on the corresponding bracket, each bracket being relatively more rigid than the corresponding latch whereby the opposed surfaces comprise means for preventing overstress of the latch.

6. The socket of claim 1 wherein polarizing means are located on at least one outer enclosed end.

7. A low profile, high density socket for interconnecting a single in-line memory module to a printed circuit board, the module comprising a plurality of microelectronic packages mounted on a low profile substrate, the substrate having edge traces leading from module contacts to edge contacts along a lower substrate edge and a hole along at least one side edge, the socket comprising: a plurality of terminals each comprising means for interconnection between the substrate edge contacts and the printed circuit board; and an elongate dielectric housing comprising a central body having an elongate channel opening along an upper module receiving face, the terminals being positioned side by side along the channel, means for positioning and supporting a module along opposite sides of the substrate upon complete insertion of the module substrate lower edge into the channel with the edge contacts in electrical engagement with the terminals, the positioning and supporting means extending upwardly from the module receiving face, the positioning and supporting means comprising a latching boss and a resilient arm, the latching boss being at the upper edge of the positioning and supporting means spaced from the module receiving face and extending transversely of and over at least a portion of the channel, the resilient arm being deflectable relative to the housing upon insertion of the module into the socket, continued insertion of the module into the socket bringing the hole in the substrate into alignment with the latching boss, the resilient arm returning to an undeflected position after complete insertion of the module into the channel, the latching boss extending into the hole in the substrate retain the module in the housing with the resilient arm in the undeflected position; the central body and the positioning and supporting means, including the latching boss and resilient arm, comprising a one-piece molded member with the positioning and supporting means, including the latching boss and resilient arm, being integral with the central body, the resilient arm comprising an integral portion of the housing and being joined to the housing only along the base of the resilient arm.

8. The socket of claim 7 wherein the latching boss is spaced inwardly from the end of the channel for insertion into the hole in the substrate.

9. The high density socket of claim 7 wherein the positioning and supporting means is perpendicular to the printed circuit board when the socket is disposed on the printed circuit board.

* * * * *